US007922531B2

(12) United States Patent
Takahashi

(10) Patent No.: US 7,922,531 B2
(45) Date of Patent: Apr. 12, 2011

(54) CONNECTOR SHIELD CASE

(75) Inventor: Kazuya Takahashi, Zama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/085,748

(22) PCT Filed: Dec. 1, 2006

(86) PCT No.: PCT/US2006/046242

§ 371 (c)(1),
(2), (4) Date: May 28, 2009

(87) PCT Pub. No.: WO2007/064998

PCT Pub. Date: Jun. 7, 2007

(65) Prior Publication Data

US 2009/0298334 A1 Dec. 3, 2009

(30) Foreign Application Priority Data

Dec. 1, 2005 (JP) ..... 2005-347691

(51) Int. Cl.
*H01R 13/648* (2006.01)

(52) U.S. Cl. ..... 439/607.01

(58) Field of Classification Search ..... 439/607.01, 439/607.17, 676, 541.5, 489, 941
See application file for complete search history.

(56) References Cited

U.S. PATENT DOCUMENTS

| | | | | |
|---|---|---|---|---|
| 6,113,428 | A * | 9/2000 | Yeh | 439/607.17 |
| 6,537,110 | B1 * | 3/2003 | Korsunsky et al. | 439/676 |
| 6,540,564 | B1 * | 4/2003 | Ko | 439/676 |
| 7,008,762 | B2 * | 3/2006 | Zhang et al. | 439/541.5 |
| 2001/0053630 | A1 * | 12/2001 | Shi et al. | 439/607 |

FOREIGN PATENT DOCUMENTS

EP 0 898 327 A2 2/1999

OTHER PUBLICATIONS

International Search Report for PCT/US06/046242, Dec. 12, 2006, Dec. 1, 2006.

* cited by examiner

*Primary Examiner* — Jean F Duverne
(74) *Attorney, Agent, or Firm* — Timothy M. Morella

(57) ABSTRACT

A connector shield case having a tubular shape and is attached to a housing having a plurality of terminals to thereby surround the terminals. The connector shield case is formed by bending a metal blank having a predetermined shape. The connector shield case comprises a ceiling plate portion, side wall portions extending downward from corresponding opposite side ends of the ceiling plate portion, mounting projecting-leg portions extending downward from each of the side wall portions, a bottom plate support portion connecting, at opposite ends, with the side wall portions and a bottom plate portion in parallel with the ceiling plate portion and connecting with the bottom plate support portion via a bend portion. With respect to the front-rear direction, the bottom plate portion overlaps in position with at least one of the mounting projecting-leg portions.

18 Claims, 11 Drawing Sheets

CONNECTOR SHIELD CASE

BACKGROUND OF THE INVENTION

1. Field of the Invention

The present invention relates to a connector shield case.

2. Description of the Related Art

Conventionally, an electric wire, such as a cable, is connected to a circuit board, such as a printed circuit board, by means of a receptacle connector for receiving a plug connector connected to an end portion of the electric wire. The receptacle connector is configured such that a shield case formed of a metal plate is attached around a housing (refer to, for example, Japanese Patent Application Laid-Open (kokai) No. 2004-192838).

FIG. 11 is a perspective view of a conventional receptacle connector. In FIG. 11, reference numeral 301 denotes a receptacle connector to be mounted on a circuit board. The receptacle connector includes a housing 302 for holding terminals 306, and a rectangular, tubular shield case 303 which surrounds the housing 302. The shield case 303 is formed by bending into a rectangular, tubular shape a single metal blank having a predetermined shape, in the form of a development of the shield case 303. Opposite ends of the metal blank are joined together at a joint portion 304. In this case, an elastic lock piece 307 is bent inward at a bend portion 308, and then the metal blank is formed into the rectangular, tubular shape. The elastic lock piece 307 is engaged with a lock recess portion of an unillustrated plug connector, thereby locking the received plug connector.

Mounting projecting-leg portions 305 extend downward from opposite side ends of a bottom portion of the shield case 303. The projecting-leg portions 305 are inserted into corresponding through holes formed in an unillustrated circuit board and are fixed by soldering. By this procedure, the receptacle connector 301 is fixedly mounted on the circuit board.

However, the conventional shield case 303 fails to sufficiently increase the length of the projecting-leg portions 305, potentially resulting in low mounting strength in mounting the receptacle connector 301 onto a circuit board. This is because the shield case 303 is formed by bending a single metal blank having a predetermined shape, in the form of a development of the shield case 303. In a developed state as viewed before bending is performed, the projecting-leg portions 305 project into a bottom portion of the shield case 303 from opposite sides. The metal blank is bent along opposite side lines of the bottom portion, whereby the projecting-leg portions 305 extend perpendicularly to the bottom portion. Thus, the width of the bottom portion limits the feasible maximum length of the projecting-leg portions 305.

Particularly, in the case where an interface standard or the like requires formation of a lock piece on the bottom portion, the feasible maximum length of the projecting-leg portions 305 is further limited, potentially resulting in the projecting-leg portions 305 failing to extend through corresponding through holes formed in a circuit board. In this case, since the projecting-leg portions 305 do not project from the back side of the circuit board, soldering becomes insufficient, resulting in low mounting strength in mounting the receptacle connector 301 onto the circuit board.

In the case of the illustrated receptacle connector 301, since the elastic lock piece 307 is formed by bending inward a metal blank at the bend portion 308, the projecting-leg portions 305 can assume a certain effective length. However, a bottom plate is absent in a wide region of the bottom portion other than a region in the vicinity of the bend portion 308. As a result, the shield case 303 fails to exhibit sufficient shielding effect. Also, difficulty is involved in securing sufficient strength.

SUMMARY OF THE INVENTION

An object of the present invention is to solve the above-mentioned problems in the conventional connector shield case and to provide a connector shield case which is formed such that, in the course of formation into a tubular shape by bending a metal blank having a predetermined shape, a portion of the metal blank is bent outward so as to form a bottom plate portion thereof, whereby mounting projecting-leg portions can have a sufficient length to thereby provide high mounting strength, and the bottom plate portion can exhibit sufficient shielding effect and can impart sufficient strength thereto.

To achieve the above object, a connector shield case of the present invention has a tubular shape and is attached to a housing having a plurality of terminals to thereby surround the terminals. The connector shield case is formed by bending a metal blank having a predetermined shape. The connector shield case comprises a ceiling plate portion; side wall portions extending downward from corresponding opposite side ends of the ceiling plate portion; mounting projecting-leg portions extending downward from each of the side wall portions; a bottom plate support portion connecting, at opposite ends, with the side wall portions; and a bottom plate portion in parallel with the ceiling plate portion and connecting with the bottom plate support portion via a bend portion. With respect to the front-rear direction, the bottom plate portion overlaps in position with at least one of the mounting projecting-leg portions.

Preferably, as viewed before the bend portion is formed, with respect to the front-rear direction, the bottom plate portion differs in position from the mounting projecting-leg portions; and as viewed after the bend portion is formed, with respect to the front-rear direction, the bottom plate portion overlaps in position with at least one of the mounting projecting-leg portions.

Preferably, the bottom plate support portion includes a reinforcement portion extending in the front-rear direction and having a width narrower than that of the bottom plate portion; and as viewed before the bend portion is formed, with respect to the front-rear direction, the reinforcement portion overlaps in position with the mounting projecting-leg portions; and as viewed after the bending portion is formed, the reinforcement portion is located above the bottom plate portion.

Preferably, as viewed before the bend portion is formed, with respect to the front-rear direction, the bottom plate portion is located frontward of the bottom plate support portion; and the bend portion is formed by bending the bottom plate portion outward in relation to the bottom plate support portion.

Preferably, the bottom plate portion includes a lock portion for locking a counterpart connector through elastic deformation; and an end of the lock portion projects above an upper surface of the reinforcement portion and locks the counterpart connector.

Preferably, the bottom plate portion includes a positioning recess portion located at an end thereof; and the reinforcement portion includes a positioning projection portion located at an end thereof and fitted into the positioning recess portion.

Preferably, the housing includes an engagement recess portion; and the end of the bottom plate portion is engaged with the engagement recess portion.

Preferably, the mounting projecting-leg portions and each of the side wall portions lie in the same plane.

According to the present invention, in the course of forming the tubular shield case by bending a metal blank having a predetermined shape, a portion of the metal blank is bent outward so as to form the bottom plate portion of the shield case. Accordingly, the mounting projecting-leg portions can have a sufficient length, thereby providing high mounting strength. Also, the bottom plate portion can exhibit sufficient shielding effect and can impart sufficient strength to the connector shield case.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION OF THE DISCLOSED EMBODIMENT

Figure 1:
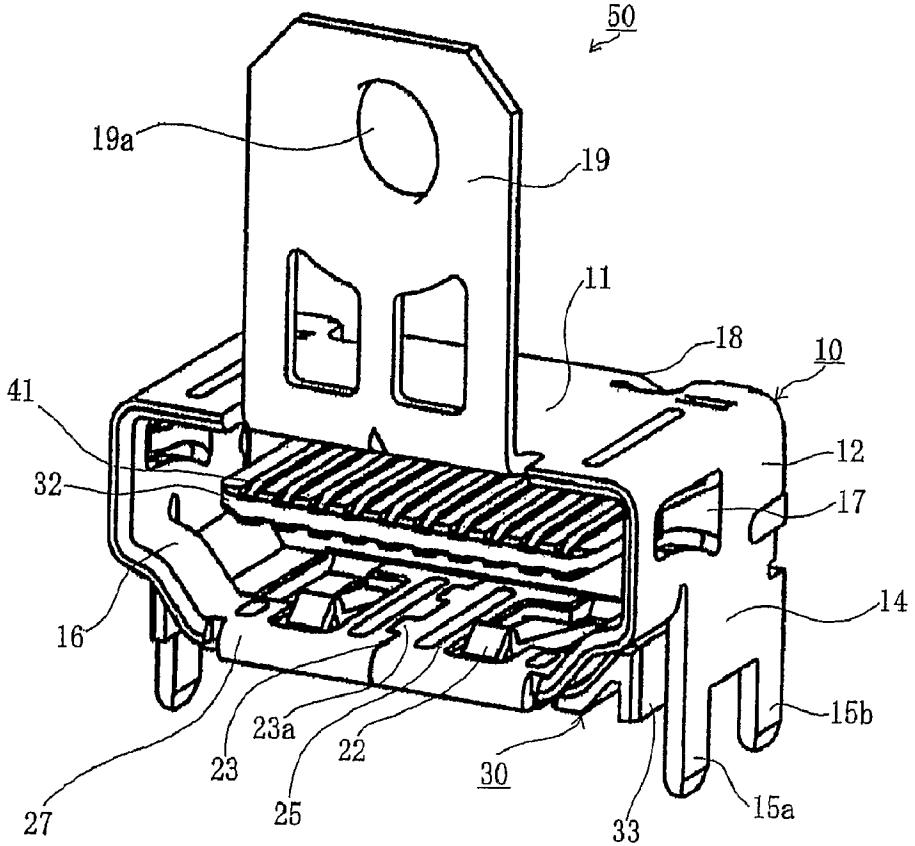
FIG. 1 is a perspective view showing a state in which a connector shield case according to an embodiment of the present invention is attached to a housing.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
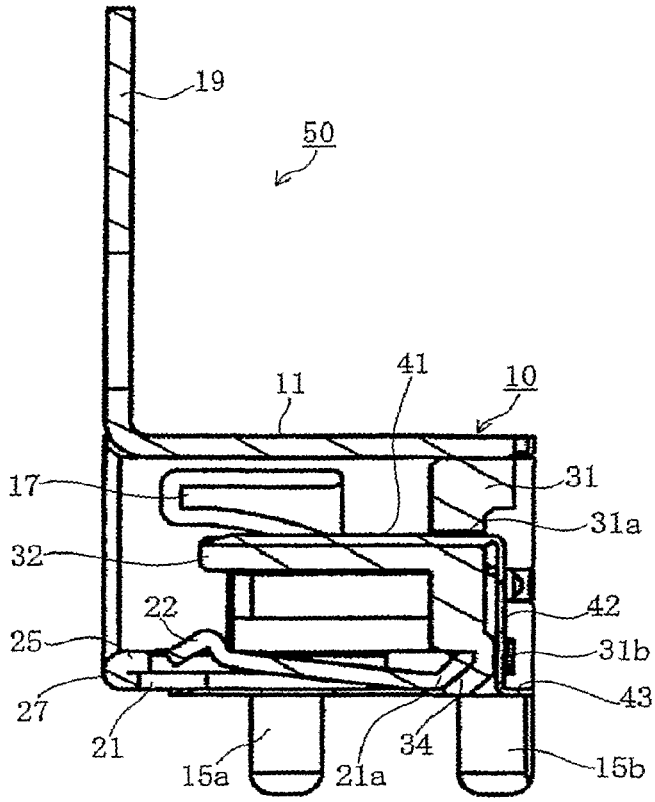
FIG. 2 is a cross-sectional view showing the state in which the connector shield case according to the embodiment is attached to the housing.

In FIGS. 1 and 2, reference numeral 50 denotes a connector which includes a unitary housing 30 formed of an electrically insulative material, such as a synthetic resin, and a connector shield case 10 according to the present embodiment and formed of an electrically conductive metal plate. The connector 50 is mounted on a circuit board used in, for example, electronic equipment, such as a TV, a videorecorder, a DVD recorder, or a personal computer, and is engaged with an unillustrated counterpart connector to thereby electrically connect the circuit board and a cable connected to the counterpart connector. The cable may be of any kind, so long as it is adapted to transmit electric power or electric signals.

In the present embodiment, terms for expressing direction, such as up, down, left, right, front, and rear, are used for explaining the structure and action of respective portions of the connector 50, the housing 30, and the connector shield case 10; however, these terms represent respective directions for the case where the connector 50, the housing 30, and the connector shield case 10 are used in respective orientations shown in the drawings, and must be construed to represent corresponding different directions when the orientations of the connector 50, the housing 30, and the connector shield case 10 are changed.

The connector shield case 10 is formed of a single metal plate and by bending, at predetermined positions, a single metal blank having a predetermined shape into a rectangular, tubular shape. The connector shield case 10 determines the external shape of the connector 50. One opening (a left opening in FIG. 2) of the connector shield case 10 serves as an insertion port through which a counterpart connector is inserted. The counterpart connector is moved in the front-rear direction (the left-right direction in FIG. 2) in relation to the connector shield case 10 to thereby be removed or inserted.

The connector shield case 10 includes a ceiling plate portion 11; two side wall portions 12; a front mounting projecting-leg portion 15*a*; a rear mounting projecting-leg portion 15*b*; two connection arm portions 16; a frame attachment projection portion 19; a bottom plate portion 21; and a bottom plate support portion 25. The ceiling plate portion 11 is a flat-plate portion having a substantially rectangular shape. The side wall portions 12 extend downward from the corresponding opposite side ends of the ceiling plate portion 11 via respective right-angle bend portions. The frame attachment projection portion 19 extends upward from the front end, which is located on a side toward the insertion port, of the ceiling plate portion 11 via a right-angle bend portion. When the connector 50 is mounted in the vicinity of the frame of the aforementioned electronic equipment, the frame attachment projection portion 19 is used to fix the connector 50 to the frame. The frame attachment projection portion 19 has an attaching-member insertion hole 19*a* through which an attaching member, such as a screw or a bolt, is inserted. If fixation to the frame is not required, the frame attachment projection portion 19 may be eliminated.

The side wall portions 12 include respective retainer fingers 17 for retaining from opposite sides a counterpart connector which is inserted through the insertion port of the connector 50 and engaged with the connector 50. Each of the retainer fingers 17 is such a cantilever-like, elastic piece that a base portion is integral with the side wall portion 12, while an end is free and projects beyond the inner surface of the side wall portion 12 into the interior of the connector shield case 10.

The front mounting projecting-leg portion 15*a* and the rear mounting projecting-leg portion 15*b* extend downward from the lower end of each of the side wall portions 12 via a flat-plate-like leg connection portion 14. The front mounting projecting-leg portions 15*a* and the rear mounting projecting-leg portions 15*b* are inserted into corresponding through holes formed in the circuit board and fixed by soldering or the like, thereby fixing the connector 50 to the circuit board. In collective description of the front and rear mounting projecting-leg portions 15*a* and 15*b*, the term "mounting projecting-leg portion 15" will be used. Desirably, the mounting projecting-leg portion 15 is formed such that the same and each of the side wall portions 12 lie in the same plane, and in such a manner as to extend straight; i.e., without any bend, from the lower end of the side wall portion 12. If the mounting projecting-leg portion 15 has any bend, the same is prone to be bent at the bend, resulting in a drop in strength. In the illustrated example, two mounting projecting-leg portions 15 are provided each at the left and the right of the connector 50. However, the number and position of the mounting projecting-leg portions 15 can be changed as appropriate so as to coincide with, for example, the number and position of the through holes formed in the circuit board.

The connection arm portions 16 extend obliquely downward toward the interior of the connector shield case 10 from the corresponding lower ends of the side wall portions 12 at end portions located on a side toward the insertion port. The opposite ends of the bottom plate support portion 25 are integral with corresponding ends of the left and right connection arm portions 16, the ends being opposite those integral with the side wall portions 12. The bottom plate portion 21 is integral with the bottom plate support portion 25 at an end located on a side toward the insertion port, via an outward bend portion 27. As shown in FIG. 2, the bottom plate portion 21 is located under the bottom plate support portion 25 and extends from the outward bend portion 27 toward a side opposite the insertion port; i.e., toward the depth of the connector 50, in parallel with the ceiling plate portion 11. An inclination portion 21*a* directed obliquely upward is formed at an end of the bottom plate portion 21; i.e., an end located in the depth of the connector 50.

The bottom plate portion 21 includes two lock portions 22 adapted to lock a shield case of a counterpart connector which is inserted through the insertion port and engaged with the connector 50. Each of the lock portions 22 is such a cantilever-like, elastic piece that a base portion is integral with the bottom plate portion 21, while an end is free and projects beyond the upper surface of the bottom plate support portion 25 into the interior of the connector shield case 10. The lock portions 22 are engaged with unillustrated corresponding engagement recess portions formed in the shield case of the counterpart connector, thereby locking the shield case of the counterpart connector. A swelled portion for engagement is formed at an end of each of the lock portions 22. The swelled portions of the lock portions 22 are engaged with the corresponding engagement recess portions of the shield case of the counterpart connector.

A joint portion 23 extends in the front-rear direction at the center of the bottom plate portion 21 and bottom plate support portion 25. The joint portion 23 arises as a result of bending a single metal blank having a predetermined shape as mentioned previously and joining the opposite ends of the bent metal blank. A plurality of projections are formed at one end portion of the metal blank, whereas a plurality of corresponding recesses are formed at the other end portion of the metal blank. The projections and the corresponding recesses are engaged with each other and then crimped together, thereby forming a plurality of crimp portions 23*a*. The crimp portions 23*a* strengthen the joining of the opposite end portions of the bent metal blank.

The housing 30 includes a deep wall portion 31; a tongue portion 32; and two lower arm portions 33. The deep wall portion 31 is a thick-plate portion having a shape similar to the cross-sectional shape of a rectangular tube of the connector shield case 10. The deep wall portion 31 is inserted into the rectangular tube and fixed to the connector shield case 10, thereby functioning as a wall for closing an opening opposite the insertion port. The tongue portion 32 is a plate-like portion which extends horizontally (in the left-right direction in FIG. 2) and projects from the deep wall portion 31 toward the insertion port. A plurality of grooves extending in the front-rear direction are formed on the upper and lower surfaces of the tongue portion 32.

A body portion of each of terminals 41 formed of an electrically conductive metal is accommodated in the corresponding groove of the tongue portion 32. The body portion of the terminal 41 is inserted through a corresponding terminal insertion hole 31*a* formed in the deep wall portion 31 and is disposed in the groove such that a front end (a left end in FIG. 2) is directed toward the insertion port. As shown in FIG. 2, each of the terminals 41 has a side-view shape resembling a crank such that a connection portion 42 extends downward from the rear end (right end in FIG. 2) of the body portion extending in the front-rear direction and such that a tail portion 43 extends in the front-rear direction from the lower end of the connection portion 42. The connection portion 42 extends along the rear wall of the deep wall portion 31 and is supported by a terminal support portion 31*b* formed on the rear wall. The lower surface of the tail portion 43 is substantially flush with the lower surface of the connector 50 and is fixed, by soldering or the like, to an unillustrated corresponding metal connection pad formed on a circuit board. By this procedure, the terminals 41 are electrically connected to corresponding electrically conductive traces of the circuit board which are connected to the corresponding connection pads.

In FIG. 2, only the terminal 41 accommodated in the corresponding groove formed on the upper surface of the tongue portion 32 is illustrated, and the terminal 41 accommodated in the corresponding groove formed on the lower surface of the tongue portion 32 is not illustrated. The terminal 41 to be accommodated in the groove formed on the lower surface of the tongue portion 32 is similar in structure to the terminal 41 to be accommodated in the groove formed on the upper surface of the tongue portion 32, except that the length of the connection portion 42 is shorter.

An engagement recess portion 34 is formed at the lower end of the front wall of the deep wall portion 31. The inclination portion 21*a* formed at the end of the bottom plate portion 21 is latched in the engagement recess portion 34. Thus, the bottom plate portion 21 which extends from the outward bend portion 27 in the direction opposite the insertion port is supported by the deep wall portion 31, whereby its posture is stabilized.

The lower arm portions 33 extend toward the insertion port from the corresponding lower ends of the laterally opposite end walls of the deep wall portion 31. The lower arm portions 33 close corresponding open regions between the side wall portions 12 and the bottom plate portion 21 of the connector shield case 10. The connector shield case 10 further includes two upper latch nails 18 which are formed on the rear end of the ceiling plate portion 11 located opposite the insertion port of the connector 50, and two side latch nails 13 which are formed on the corresponding rear ends of the side wall portions 12 located opposite the insertion port of the connector 50 and which will be described later. The upper latch nails 18 and the side latch nails 13 are latched to the deep wall portion 31, thereby ensuring the joining of the connector shield case 10 and the housing 30.

Next, the structure of the connector shield case 10 will be described in detail. FIGS. 3 to 6 show the connector shield case 10 in such a state that the housing 30 and the terminals 41 are removed from the connector 50 as shown in FIGS. 1 and 2. As shown in FIG. 4, the upper latch nails 18 formed on the ceiling plate portion 11 and the side latch nails 13 formed on the side wall portions 12 are bent so as to latch to the housing 30.

Figure 3:
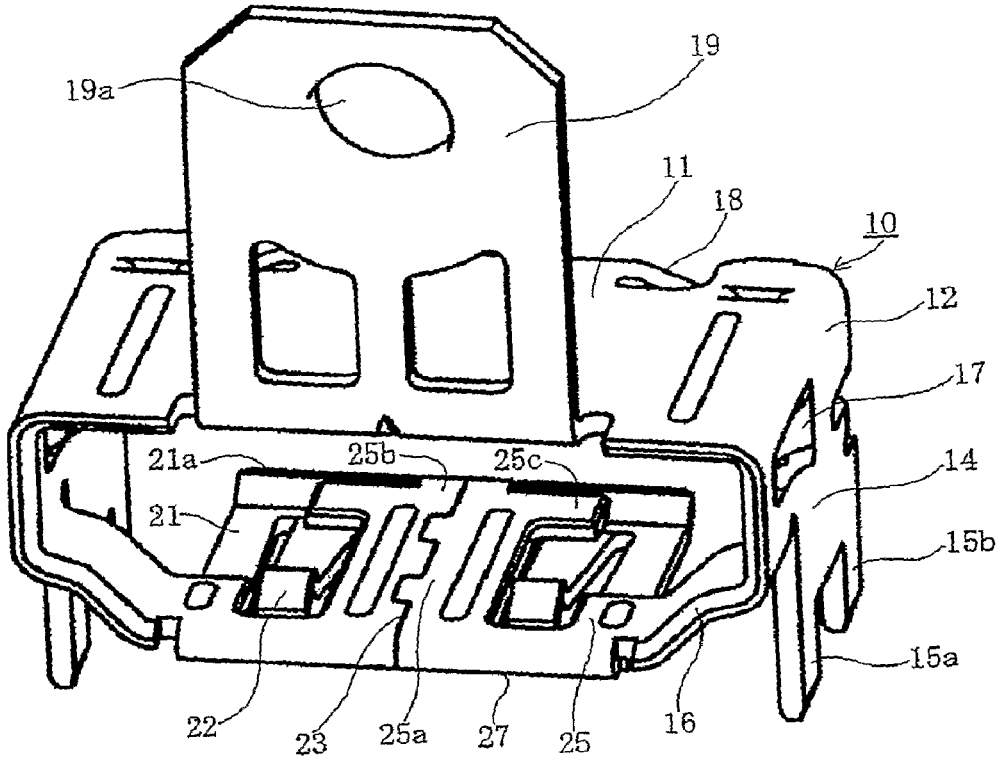
FIG. 3 is a perspective view of the connector shield case according to the embodiment as viewed from an insertion port side.
Figure 4:
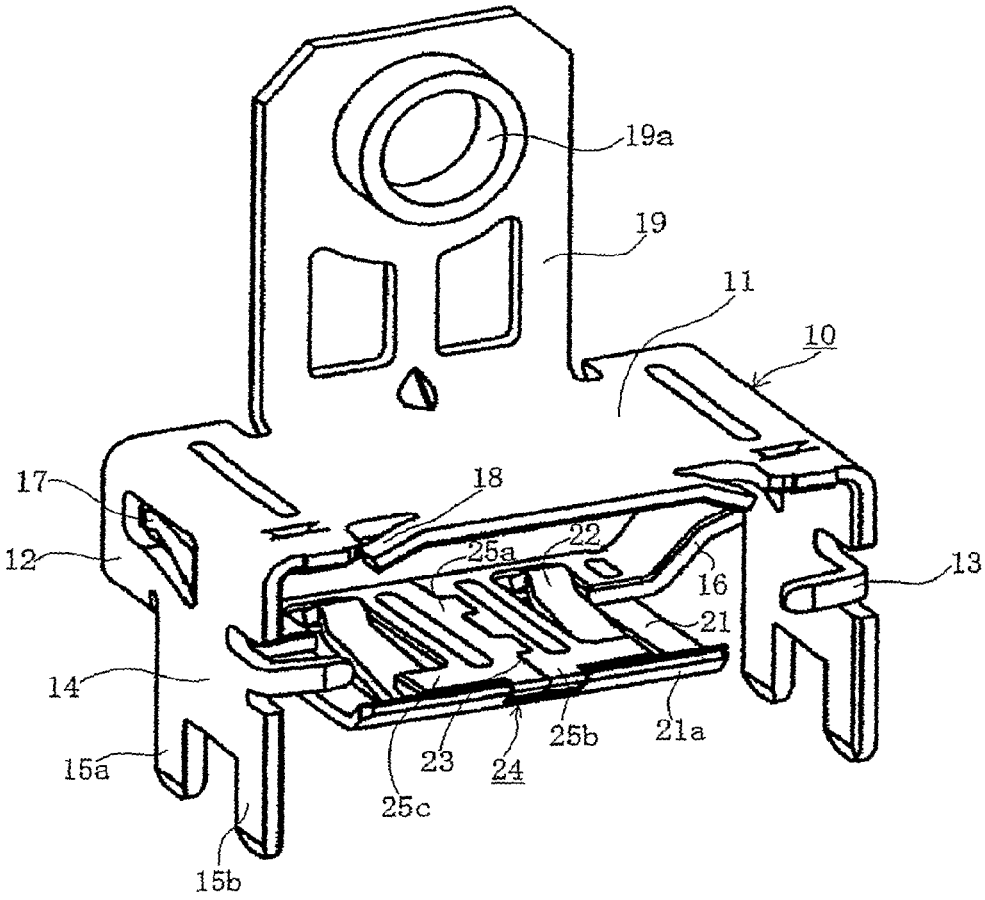
FIG. 4 is a perspective view of the connector shield case according to the embodiment as viewed from a side opposite the insertion port.

As shown in FIGS. 3 and 4, the bottom plate support portion 25 includes a reinforcement portion 25*a* which extends toward the depth of the connector 50 in parallel with the ceiling plate portion 11 and the bottom plate portion 21. The reinforcement portion 25*a* is a narrow portion having a width narrower than that of the bottom plate portion 21, and extends toward the depth of the connector 50 through the gap between the two lock portions 22 of the bottom plate portion 21. Accordingly, the reinforcement portion 25*a* is formed such that its base portion is integral with only a central portion of the bottom plate support portion 25. The joint portion 23 extends in the front-rear direction through the lateral center of the reinforcement portion 25*a*.

Figure 6:
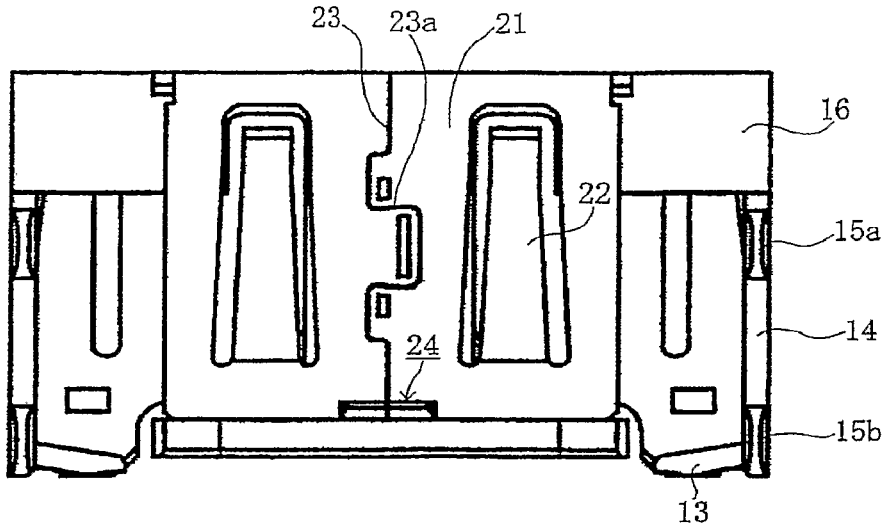
FIG. 6 is a bottom view of the connector shield case according to the embodiment.

A positioning projection portion 25*b* projects from a laterally central portion of an end of the reinforcement portion 25*a*. Two wing portions 25*c* extend laterally from corresponding opposite sides of the positioning projection portion 25*b*. As shown in FIGS. 4 and 6, a positioning recess portion 24 is formed at a laterally central portion of the inclination portion 21*a* formed at the end of the bottom plate portion 21. The positioning projection portion 25*b* is fitted into the positioning recess portion 24. By this procedure, relative positioning in the lateral direction; i.e., in the width direction, is performed between the end of the bottom plate portion 21 and the end of the reinforcement portion 25*a*. The tip edge of the wing portions 25*c* abut the inclination portion 21*a*, whereby relative positioning in the front-rear direction; i.e., in the longitudinal direction, is performed between the end of the bottom plate portion 21 and the end of the reinforcement portion 25*a*. Thus, the bottom plate portion 21 is enhanced in strength and stabilized in posture.

With respect to the front-rear direction, the bottom plate portion 21 overlaps in position with the front mounting projecting-leg portion 15*a*. That is, the bottom plate portion 21 has a sufficiently wide width and a sufficiently long length in the front-rear direction, thereby exhibiting sufficient shielding effect. As needed, the length of the bottom plate portion 21 in the front-rear direction may be increased such that, with respect to the front-rear direction, the bottom plate portion 21 overlaps in position with the rear mounting projecting-leg portion 15*b* as well.

Figure 5:
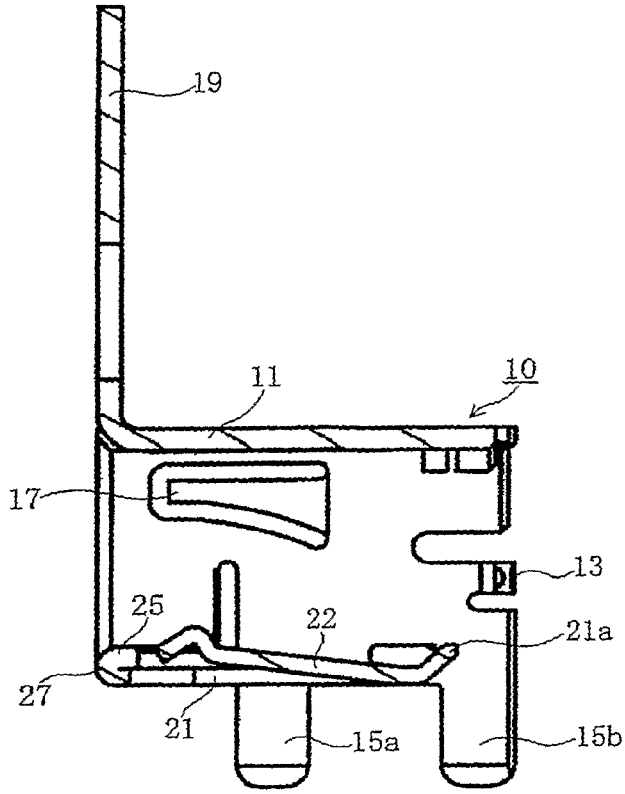
FIG. 5 is a cross-sectional view of the connector shield case according to the embodiment.

The upper surface of the reinforcement portion 25*a* abuts a bottom surface of a shield case of an inserted counterpart connector, thereby functioning as a guide surface for the bottom surface of the counterpart connector. As shown in FIG. 5, the swelled portions of the lock portions 22 project above the upper surface of the reinforcement portion 25*a* and are engaged with corresponding engagement recess portions of the shield case of the counterpart connector. During the course of insertion or removal of the counterpart connector, the bottom surface of the shield case of the counterpart connector presses down the swelled portions of the lock portions 22; thus, the lock portions 22 are moved downward. However, since the reinforcement portion 25*a* keeps the bottom surface of the shield case of the counterpart connector away from the bottom plate portion 21, even when the swelled portions of the lock portions 22 are pressed downward, no portions of the lock portions 22 project below the lower surface of the bottom plate portion 21; i.e., the deflection of the lock portions 22 is ensured. In other words, since the reinforcement portion 25*a* implements such a condition that the bottom of the connector shield case 10 is raised, the vertical stroke of the lock portions 22 can be equivalent to or greater than the total thickness of the two metal plates; therefore, no portions of the lock portions 22 project to the exterior of the connector shield case 10. Also, there is no need to extend a portion of the housing 30 onto the bottom plate portion 21 in order to implement a condition in which the bottom of the connector shield case 10 is raised.

Figure 7:
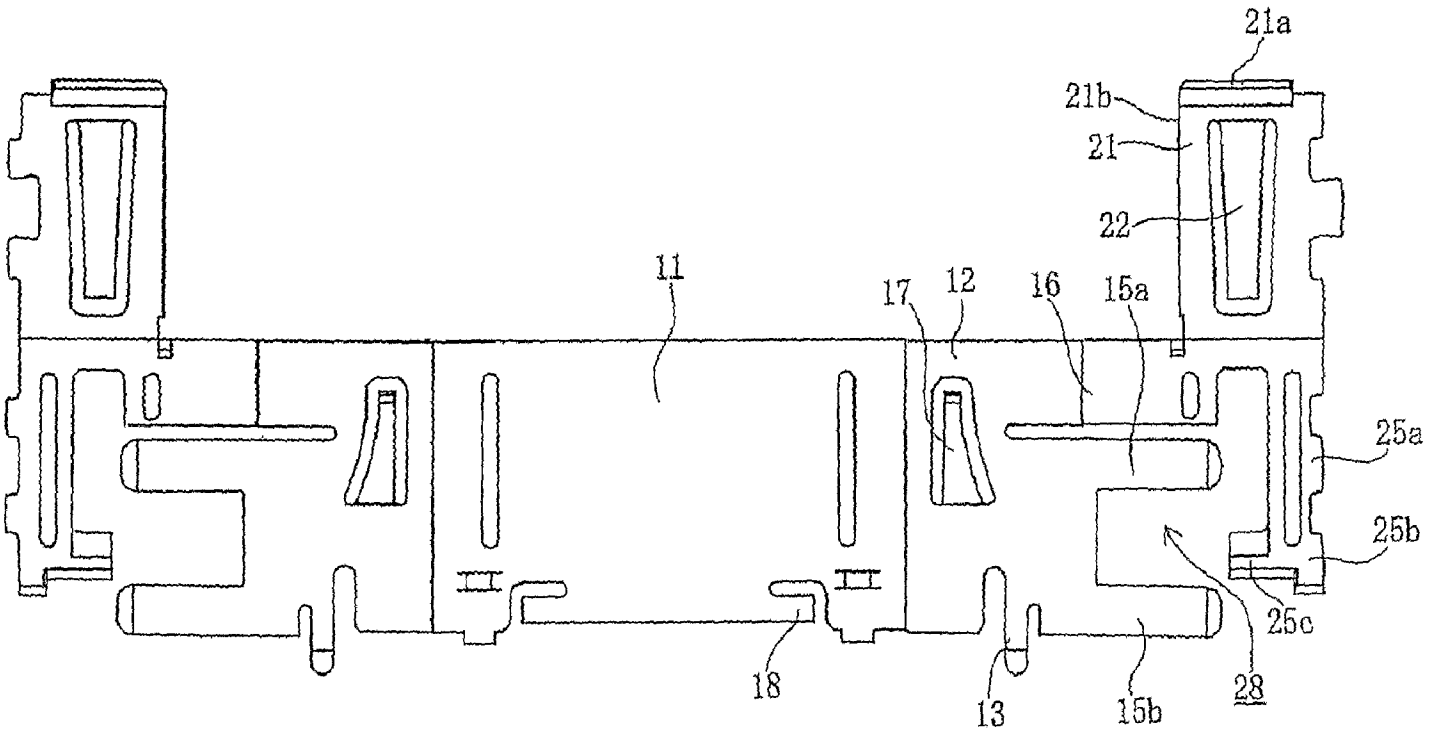
FIG. 7 is a development of the connector shield case according to the embodiment, showing a state before bending is performed.
Figure 8:
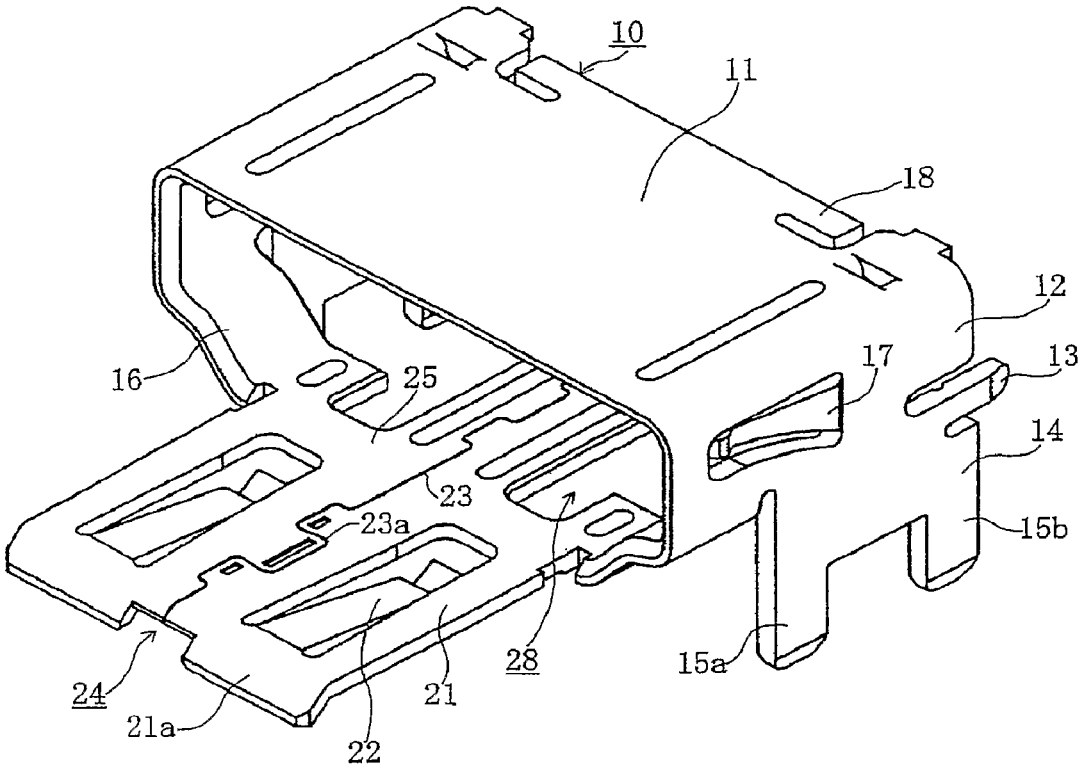
FIG. 8 is a perspective view of the connector shield case according to the embodiment, showing a state before an outward bend portion is formed.
Figure 9:
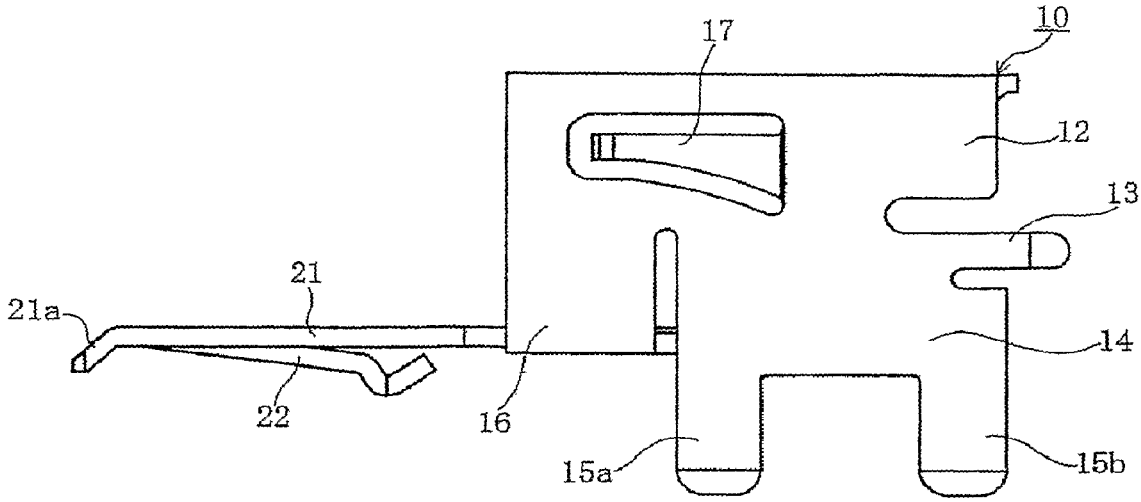
FIG. 9 is a side view of the connector shield case according to the embodiment, showing a state before the outward bend portion is formed.
Figure 10:
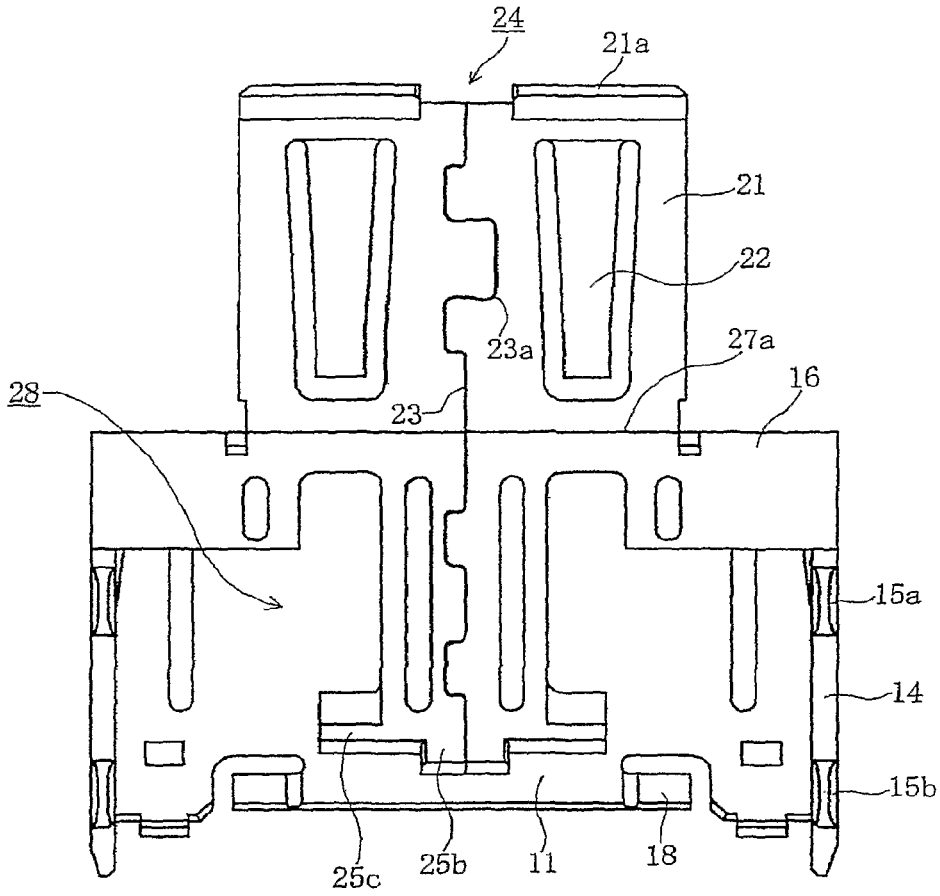
FIG. 10 is a bottom view of the connector shield case according to the embodiment, showing a state before the outward bend portion is formed.
Figure 11:
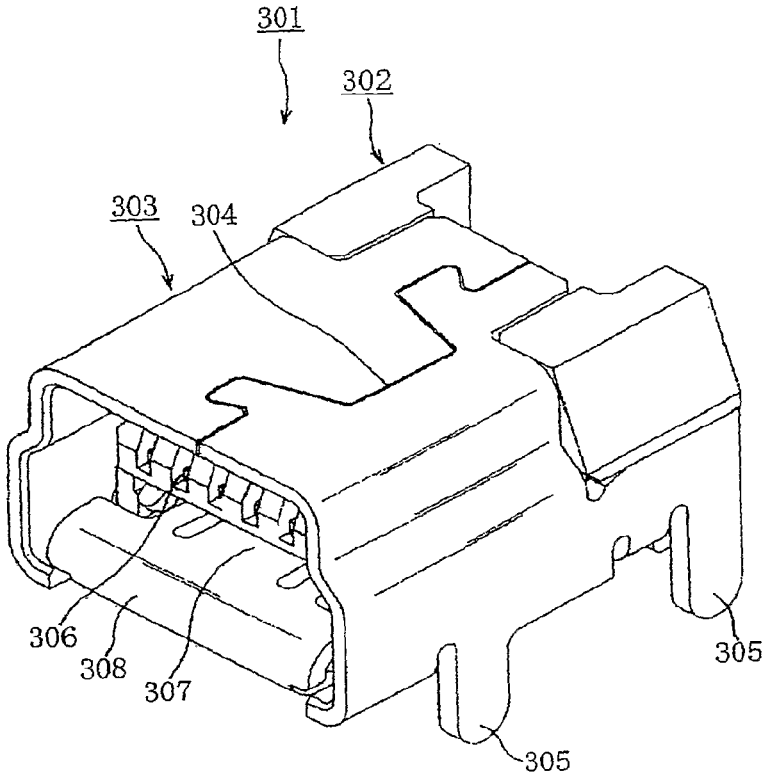
(Prior art) FIG. 11
FIG. 11 is a perspective view of a conventional receptacle connector.

Next, the structure of the connector shield case 10 before the outward bend portion 27 is formed will be described. FIG. 7 is a development of the connector shield case 10 and shows a state before bending is performed; i.e., a metal blank having a predetermined shape. FIGS. 8 to 10 show a state before an end of the bottom plate support portion 25 located on a side toward the insertion port is bent so as to direct the end of the bottom plate 21 toward the depth of the connector 50. A line 27*a* in FIG. 10 shows a position where the outward bend portion 27 is formed. For convenience of description, in FIGS. 7 to 10, the frame attachment projection portion 19 is not illustrated. The upper latch nails 18 formed on the ceiling plate portion 11, and the side latch nails 13 formed on the corresponding side wall portions 12, are in a state before they are bent.

Bending the bottom plate portion 21 in the state of FIGS. 8 to 10 outward (downward in FIG. 9) along the line 27*a* yields the bottom plate portion 21 which, as shown in FIGS. 1 to 6, is integral with the end, located on a side toward the insertion port, of the bottom plate support portion 25 via the outward bend portion 27 and which extends in parallel with the ceiling plate portion 11 toward the depth of the connector 50.

As shown in FIGS. 7, 8, and 10, an empty space 28 which is unoccupied is present on each of opposite sides of the reinforcement portion 25*a*. Referring to the development of the connector shield case 10 shown in FIG. 7, before bending is performed; i.e., when the connector shield case 10 is in the form of a metal blank having a predetermined shape, the leg connection portion 14 and the mounting projecting-leg portion 15 occupy a considerable portion of each of the empty spaces 28. When the connector shield case 10 is in the form of the metal blank having a predetermined shape, the joint portion 23 is absent, and the reinforcement portion 25*a* is divided into opposite halves located outward of the mounting projecting-leg portions 15.

In this case, as shown in FIG. 7, halves of the reinforcement portion 25*a* are located at laterally opposite ends of the metal blank having a predetermined shape. The width of the metal blank having a predetermined shape is the end-to-end dimension between the left-half reinforcement portion 25*a* and the right-half reinforcement portion 25*a*. The width of the metal blank having a predetermined shape coincides with the perimeter of the insertion port of the connector shield case 10 shown in FIG. 3 and is determined from outside dimensions of the connector 50.

As is apparent from the above description, in order to increase the length of the mounting projecting-leg portion 15, the width of the reinforcement portion 25*a* must be reduced. In the present embodiment, as mentioned previously, the reinforcement portion 25*a* is a narrow portion having a width narrower than that of the bottom plate portion 21; thus, the length of the mounting projecting-leg portion 15 can be set long. By this procedure, the mounting projecting-leg portion 15 can have a sufficiently long projection beyond the lower surface of the connector 50. Thus, even when a circuit board is thick, the mounting projecting-leg portion 15 inserted into a through hole formed in the circuit board can be such that its end projects from the rear surface of the circuit board by a sufficiently large amount. Therefore, the mounting projecting-leg portion 15 can be reliably soldered to the circuit board, thereby enhancing mounting strength in mounting the connector 50 onto the circuit board.

If the bottom plate portion 21 replaces the reinforcement portion 25*a*; i.e., if the bottom plate portion 21 is designed not to be bent outward, but to extend toward the depth of the connector 50 directly from the bottom plate support portion 25, a left half of the bottom plate portion 21 and a right half of the bottom plate portion 21 are located at laterally opposite ends of the metal blank having a predetermined shape. In this case, since the lock portions 22 are formed on the bottom plate portion 21, narrowing the width of the bottom plate portion 21 is difficult. Also, since the connector 50 conforms to HDMI (R), the lateral position of the lock portions 22 cannot be changed; therefore, narrowing the width of the bottom plate portion 21 by means of changing the position of the lock portions 22 is impossible. As a result, the mounting projecting-leg portion 15 cannot be set long, and thus the mounting projecting-leg portion 15 cannot have a sufficiently long projection beyond the lower surface of the connector 50.

By contrast, in the present embodiment, as shown in FIGS. 8 to 10, as viewed before the outward bend portion 27 is formed, with respect to the front-rear direction, the bottom plate portion 21 differs in position from the mounting projecting-leg portion 15. Accordingly, the length of the mounting projecting-leg portion 15 can be determined irrespective of the width of the bottom plate portion 21. For example, in FIG. 7, an end of the mounting projecting-leg portion 15 can be located laterally outward of or at substantially the same position as that of a side 21*b* of the bottom plate portion 21. Accordingly, the mounting projecting-leg portion 15 can be set long, and thus the mounting projecting-leg portion 15 can have a sufficiently long projection beyond the lower surface of the connector 50.

The above-mentioned feature is also applicable to a connector 50 which does not conform to HDMI(R); specifically, to a connector 50 in which the lock portions 22 are not formed on the bottom plate portion 21. For example, in the case of a connector 50 whose width is set relatively narrow, if, as mentioned previously, the bottom plate portion 21 replaces the reinforcement portion 25*a*, even though the width of the bottom plate portion 21 is narrow, the mounting projecting-leg portion 15 cannot be set sufficiently long. By contrast, if, as viewed before the outward bend portion 27 is formed, with respect to the front-rear direction, the bottom plate portion 21 differs in position from the mounting projecting-leg portion 15, the length of the mounting projecting-leg portion 15 can be determined irrespective of the width of the bottom plate portion 21 and thus can be set sufficiently long. This also applies to, for example, the case where, in order to enhance a shielding effect, the width of the bottom plate portion 21 needs to be expanded.

The above-mentioned feature is also applicable to the case where the joint portion 23 is absent at the bottom plate portion 21 and the reinforcement portion 25*a*; for example, to the case where the joint portion 23 extends in the ceiling plate portion 11. In this case, in a state in which the connector shield case 10 is in the form of a metal blank having a predetermined shape, the bottom plate portion 21 and the reinforcement portion 25*a* which are integral with each other are located at the lateral center of the metal blank, and the mounting projecting-leg portions 15 are located on corresponding opposite sides of the reinforcement portion 25*a*. The width of the metal blank having a predetermined shape coincides with the perimeter of the insertion port of the connector shield case 10 and is determined from outside dimensions of the connector 50. A left half of the ceiling plate portion 11 and a right half of the ceiling plate portion 11 are located at laterally opposite ends of the metal blank having a predetermined shape. The width of the metal blank having a predetermined shape is the end-to-end dimension between the left-half ceiling plate portion 11 and the right-half ceiling plate portion 11. As in the case where the joint portion 23 is present at the bottom plate portion 21 and the reinforcement portion 25*a*, narrowing the width of the reinforcement portion 25*a* allows the length of the mounting projecting-leg portion 15 to be set long.

In the case where the bottom plate portion 21 has sufficiently high strength to thereby allow elimination of the reinforcement portion 25*a*, and the joint portion 23 is present at the bottom plate portion 21 and the reinforcement portion 25*a*, the length of the mounting projecting-leg portion 15 can be increased without limitation. In this case, in a state in which the connector shield case 10 is in the form of a metal blank having a predetermined shape, nothing is present laterally outward of the mounting projecting-leg portion 15; thus, no limitation is imposed on the length of the mounting projecting-leg portion 15. In other words, since no entity which limits the length of the mounting projecting-leg portion 15 is present, the length of the mounting projecting-leg portion 15 can be set arbitrarily.

As described above, in the present embodiment, the connector shield case 10 is formed by bending a metal blank having a predetermined shape, and includes the ceiling plate portion 11; the two side wall portions 12 integral with the corresponding opposite side ends of the ceiling plate portion 11 and extending downward; the mounting projecting-leg portion 15 integral with each of the side wall portions 12 and extending downward; the bottom plate support portion 25 integral, at opposite ends, with the side wall portions 12; and the bottom plate portion 21 in parallel with the ceiling plate portion 11 and integral with the bottom plate support portion 25 via the outward bend portion 27. As viewed before the outward bend portion 27 is formed, with respect to the front-rear direction, the bottom plate portion 21 differs in position from the mounting projecting-leg portion 15; and as viewed after the outward bend portion 27 is formed, with respect to the front-rear direction, the bottom plate portion 21 overlaps in position with at least the front mounting projecting-leg portion 15*a*.

Thus, since the length of the mounting projecting-leg portion 15 can be determined irrespective of the width of the bottom plate portion 21, the length of the mounting projecting-leg portion 15 can be set long, and thus the mounting projecting-leg portion 15 can have a sufficiently long projection beyond the lower surface of the connector 50. Also, even when a circuit board is thick, the mounting projecting-leg portion 15 inserted into a through hole formed in the circuit board can be such that its end projects from the rear surface of the circuit board by a sufficiently large amount. As a result, the mounting projecting-leg portion 15 can be reliably soldered to the circuit board, thereby enhancing mounting strength in mounting the connector 50 onto the circuit board.

Also, since the length in the front-rear direction and the width of the bottom plate portion 21 can be rendered sufficiently long, the bottom plate portion 21 can exhibit sufficient shielding effect. Furthermore, by means of imparting a sufficient length in the front-rear direction and a sufficient width to the bottom plate portion 21, the strength of the tubular connector shield case 10 can be enhanced. Additionally, since no large gap is formed in the bottom of the connector shield case 10, even when an external force is applied to an inserted counterpart connector, no portion of the counterpart connector projects to the exterior of the connector 50 and comes into contact with a circuit board.

The bottom plate support portion 25 includes the reinforcement portion 25*a* extending in the front-rear direction and having a width narrower than that of the bottom plate portion 21. As viewed before the outward bend portion 27 is formed, with respect to the front-rear direction, the reinforcement portion 25*a* overlaps in position with the mounting projecting-leg portion 15; and as viewed after the outward bending portion 27 is formed, the reinforcement portion 25*a* is located above the bottom plate portion 21. In this case, since the reinforcement portion 25*a* is a narrow portion having a width narrower than that of the bottom plate portion 21, the length of the mounting projecting-leg portion 15 can be set long. Also, the reinforcement portion 25*a* can sufficiently enhance the strength of the bottom plate portion 21.

As viewed before the outward bend portion 27 is formed, with respect to the front-rear direction, the bottom plate portion 21 is located frontward of the bottom plate support portion 25; and the outward bend portion 27 is formed by bending the bottom plate portion 21 outward in relation to the bottom plate support portion 25. Accordingly, the connector shield case 10 can be readily fabricated.

The bottom plate portion 21 includes the lock portions 22 for locking a counterpart connector through elastic deformation; and the ends of the lock portions 22 project above the upper surface of the reinforcement portion 25*a* and locks the counterpart connector. In this case, since the reinforcement portion 25*a* implements such a condition that the bottom of the connector shield case 10 is raised, even when the lock portions 22 move vertically, no portions of the lock portions 22 project to the exterior of the connector shield case 10, and the deflection of the lock portions 22 is ensured. Also, there is no need to extend a portion of the housing 30 onto the bottom plate portion 21 in order to implement a condition in which the bottom of the connector shield case 10 is raised.

The bottom plate portion 21 includes the positioning recess portion 24 located at an end thereof, and the reinforcement portion 25*a* includes the positioning projection portion 25*b* located at an end thereof and fitted into the positioning recess portion 24. Thus, relative positioning is performed between the end of the bottom plate portion 21 and the end of the reinforcement portion 25*a*, whereby the bottom plate portion 21 is improved in strength and stabilized in posture.

The housing 30 includes the engagement recess portion 34, and the end of the bottom plate portion 21 is engaged with the engagement recess portion 34. Accordingly, the bottom plate portion 21 is supported at the end thereof by the housing 30 and is thus stabilized in posture.

The mounting projecting-leg portion 15 and each of the side wall portions 12 lie in the same plane. Since the mounting projecting-leg portion 15 extends straight; i.e., without any bend, from the lower end of the side wall portion 12, strength is enhanced.

The joint portion 23 arises as a result of bending a single metal blank having a predetermined shape and joining the opposite ends of the bent metal blank, and extends in the front-rear direction at the center of the bottom plate portion 21 and bottom plate support portion 25. Accordingly, only a single joint portion 23 is involved, whereby the connector shield case 10 can be readily fabricated, and the strength of the connector shield case 10 is enhanced.

The connector shield case 10 according to the present embodiment is formed of a single metal plate; has a simple structure; and is reduced in size. Thus, a required mounting area on a circuit board can be reduced.

The present invention is not limited to the above-described embodiment. Numerous modifications and variations of the present invention are possible in light of the spirit of the present invention, and they are not excluded from the scope of the present invention.

While a preferred embodiment of the present invention is shown and described, it is envisioned that those skilled in the art may devise various modifications of the present invention without departing from the spirit and scope of the appended claims.

What is claimed is:

1. A connector shield case having a tubular shape and being attached to a housing , the housing including a plurality of terminals, to thereby surround the terminals, wherein the connector shield case is formed by bending a metal blank having a predetermined shape and comprises:

a ceiling plate portion;

side wall portions , each side wall portion extending downward from corresponding opposite side ends of the ceiling plate portion;

mounting projecting-leg portions , each mounting projecting-leg portion extending downward from each side wall portion;

a bottom plate support portion, the bottom plate support portion being connected, at opposite ends, to the side wall portions; and a bottom plate portion, the bottom plate portion being disposed in parallel with the ceiling plate portion and connected to the bottom plate support portion via a bend portion;

wherein:

as viewed before the bend portion is formed, with respect to the front-rear direction, the bottom plate portion differs in position from the mounting projecting-leg portions; and as viewed after the bend portion is formed, with respect to a front-rear direction, the bottom plate portion overlaps in position with at least one of the mounting projecting-leg portions.

2. The connector shield case according to claim 1, wherein the bottom plate support portion includes a reinforcement portion extending in the front-rear direction and having a width narrower than that of the bottom plate portion.

3. The connector shield case according to claim 1, wherein the mounting projecting-leg portions and each of the side wall portions lie in the same plane.

4. The connector shield case according to claim 2, wherein, as viewed before the bend portion is formed, with respect to the front-rear direction, the reinforcement portion overlaps in position with the mounting projecting-leg portions.

5. The connector shield case according to claim 4, wherein, as viewed after the bending portion is formed, the reinforcement portion is located above the bottom plate portion.

6. The connector shield case according to claim 5, wherein the mounting projecting-leg portions and each of the side wall portions lie in the same plane.

7. The connector shield case according to claim 5, wherein as viewed before the bend portion is formed, with respect to the front-rear direction, the bottom plate portion is located frontward of the bottom plate support portion.

8. The connector shield case according to claim 7, wherein the bend portion is formed by bending the bottom plate portion outward in relation to the bottom plate support portion.

9. The connector shield case according to claim 8, wherein the mounting projecting-leg portions and each of the side wall portions lie in the same plane.

10. The connector shield case according to claim 8, wherein the bottom plate portion includes a lock portion for locking a counterpart connector through elastic deformation.

11. The connector shield case according to claim 8, wherein the bottom plate portion includes a positioning recess portion located at an end thereof.

12. The connector shield case according to claim 10, wherein an end of the lock portion projects above an upper surface of the reinforcement portion and locks the counterpart connector.

13. The connector shield case according to claim 12, wherein the mounting projecting-leg portions and each of the side wall portions lie in the same plane.

14. The connector shield case according to claim 11, wherein the reinforcement portion includes a positioning projection portion located at an end thereof and fitted into the positioning recess portion.

15. A The connector shield case according to claim 14, wherein the housing includes an engagement recess portion.

16. The connector shield case according to claim 15, wherein the end of the bottom plate portion is engaged with the engagement recess portion.

17. The connector shield case according to claim 16, wherein the mounting projecting-leg portions and each of the side wall portions lie in the same plane.

18. The connector shield case according to claim 14, wherein the mounting projecting-leg portions and each of the side wall portions lie in the same plane.

* * * * *